US007987541B2

(12) United States Patent
Oh et al.

(10) Patent No.: US 7,987,541 B2
(45) Date of Patent: Aug. 2, 2011

(54) STEAM WASHING METHOD FOR WASHING MACHINE AND WASHING MACHINE WITH THE SAME

(75) Inventors: Soo Young Oh, Seoul (KR); Kyung Chul Woo, Seoul (KR); Na Eun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 481 days.

(21) Appl. No.: 11/629,300

(22) PCT Filed: Feb. 8, 2006

(86) PCT No.: PCT/KR2006/000458

§ 371 (c)(1),
(2), (4) Date: Feb. 6, 2009

(87) PCT Pub. No.: WO2006/104310

PCT Pub. Date: Oct. 5, 2006

(65) Prior Publication Data

US 2009/0172892 A1 Jul. 9, 2009

(30) Foreign Application Priority Data

Mar. 29, 2005 (KR) ..... 10-2005-0026045

(51) Int. Cl.
*D06F 33/02* (2006.01)

(52) U.S. Cl. ..... 8/159; 68/12.02; 68/15

(58) Field of Classification Search ..... 68/12.02, 68/15; 8/159

See application file for complete search history.

(56) References Cited

U.S. PATENT DOCUMENTS

| | | | | |
|---|---|---|---|---|
| 1,501,746 | A * | 7/1924 | Carter | 68/139 |
| 3,187,524 | A * | 6/1965 | Wolverton | 68/23.5 |
| 3,203,013 | A * | 8/1965 | Buss | 8/158 |
| 3,246,491 | A * | 4/1966 | Buss | 68/12.05 |
| 3,256,720 | A * | 6/1966 | Green et al. | 68/12.17 |
| 3,935,719 | A * | 2/1976 | Henderson | 68/58 |
| 5,827,329 | A * | 10/1998 | Champeau | 8/142 |
| 7,404,304 | B2 * | 7/2008 | Yang et al. | 68/5 C |
| 7,406,737 | B2 * | 8/2008 | Yang et al. | 8/158 |
| 2005/0132503 | A1 | 6/2005 | Yang et al. | |

FOREIGN PATENT DOCUMENTS

| | | | |
|---|---|---|---|
| EP | 1469120 | A1 | 10/2004 |
| EP | 1507031 | A1 | 2/2005 |
| JP | 2004-049283 | | 2/2004 |
| KR | 2001004429 | * | 1/2001 |
| KR | 20050098162 | | 10/2005 |

OTHER PUBLICATIONS

European Patent Offfice 1 441 059 Jul. 2004.*
European Patent Office 0 816 550 Jan. 1998.*

* cited by examiner

*Primary Examiner* — Frankie L Stinson
(74) *Attorney, Agent, or Firm* — McKenna Long & Aldridge LLP

(57) ABSTRACT

The present invention relates to a method of a washing machine having a tub (21) for holding washing water, a drum (31) rotatably mounted in the tub (21), and a stem generator (51) for generating and supplying steam to the tub (21), for washing laundry with steam, and a washing machine thereof. The method includes a washing water supply step (S 10) for supplying washing water to the tub (21), a steam supply step (S80) for supplying the steam to the tub (21), and a main washing step (S110) for washing the laundry.

7 Claims, 4 Drawing Sheets

[Fig. 1]
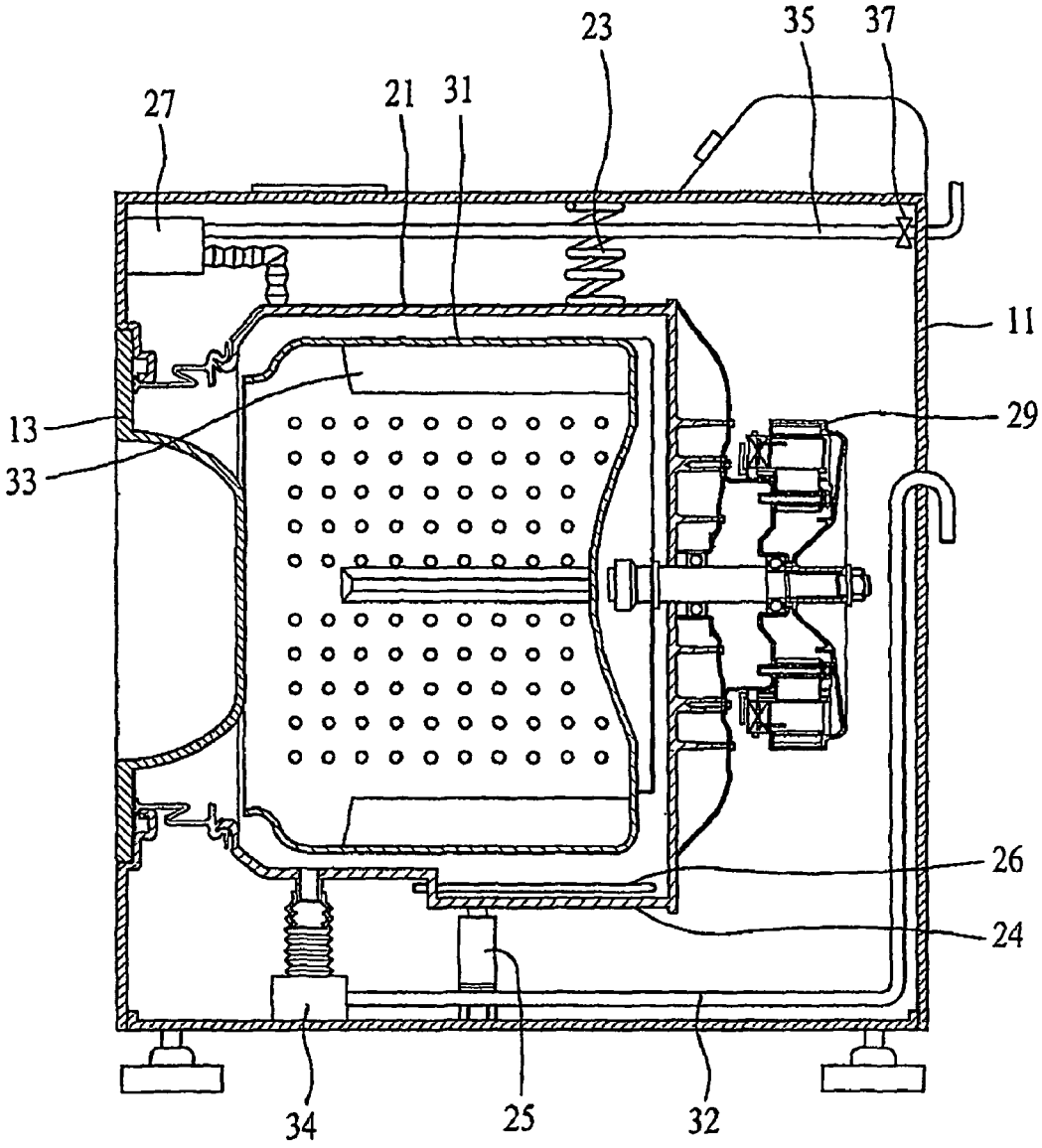

[Fig. 2]
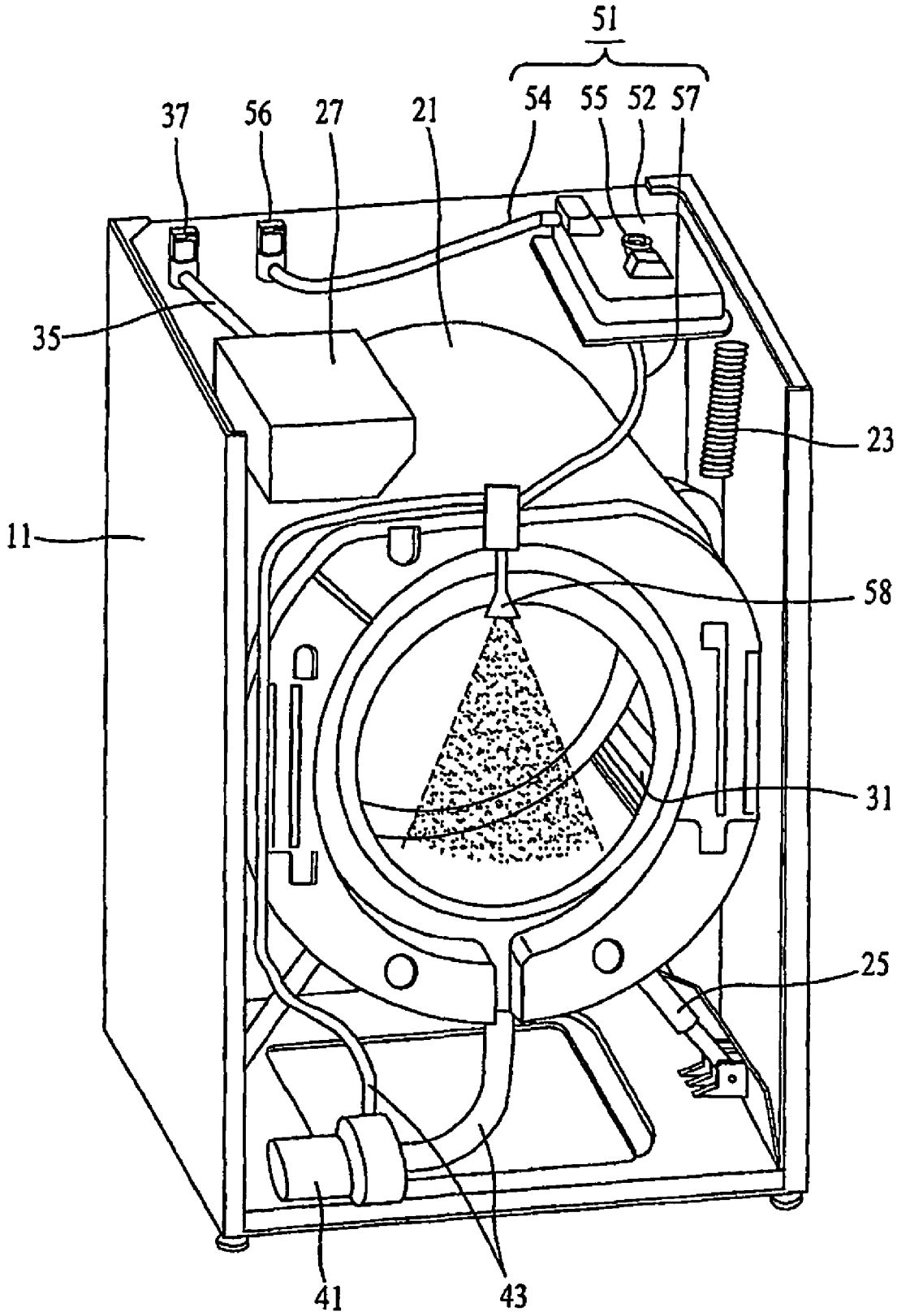

[Fig. 3]
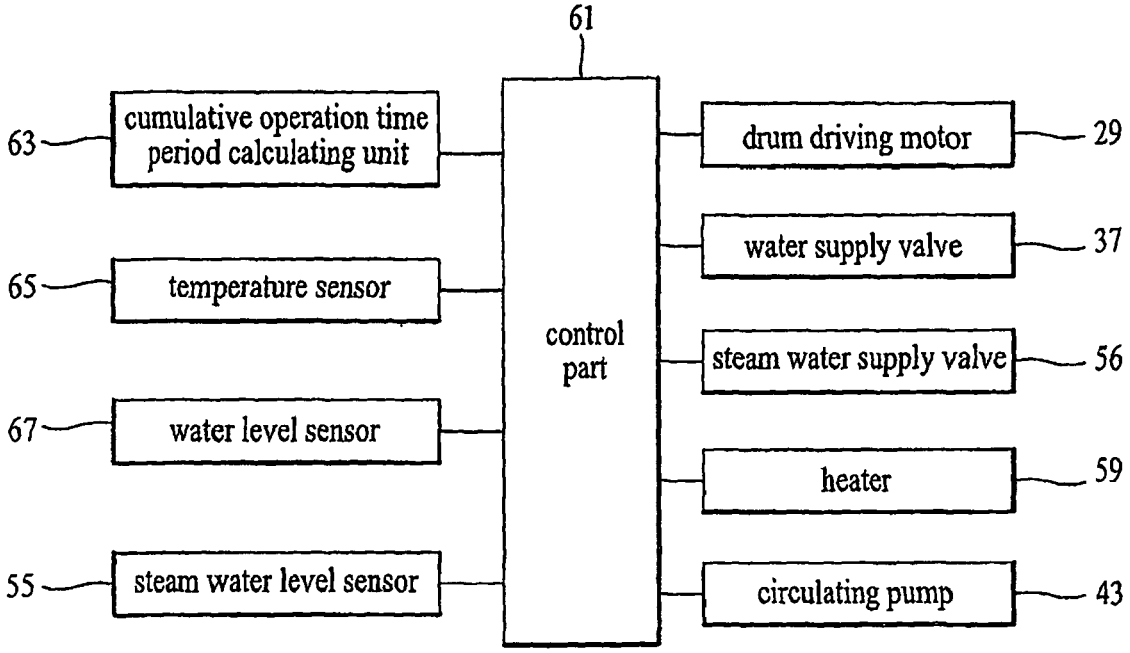

[Fig. 4]
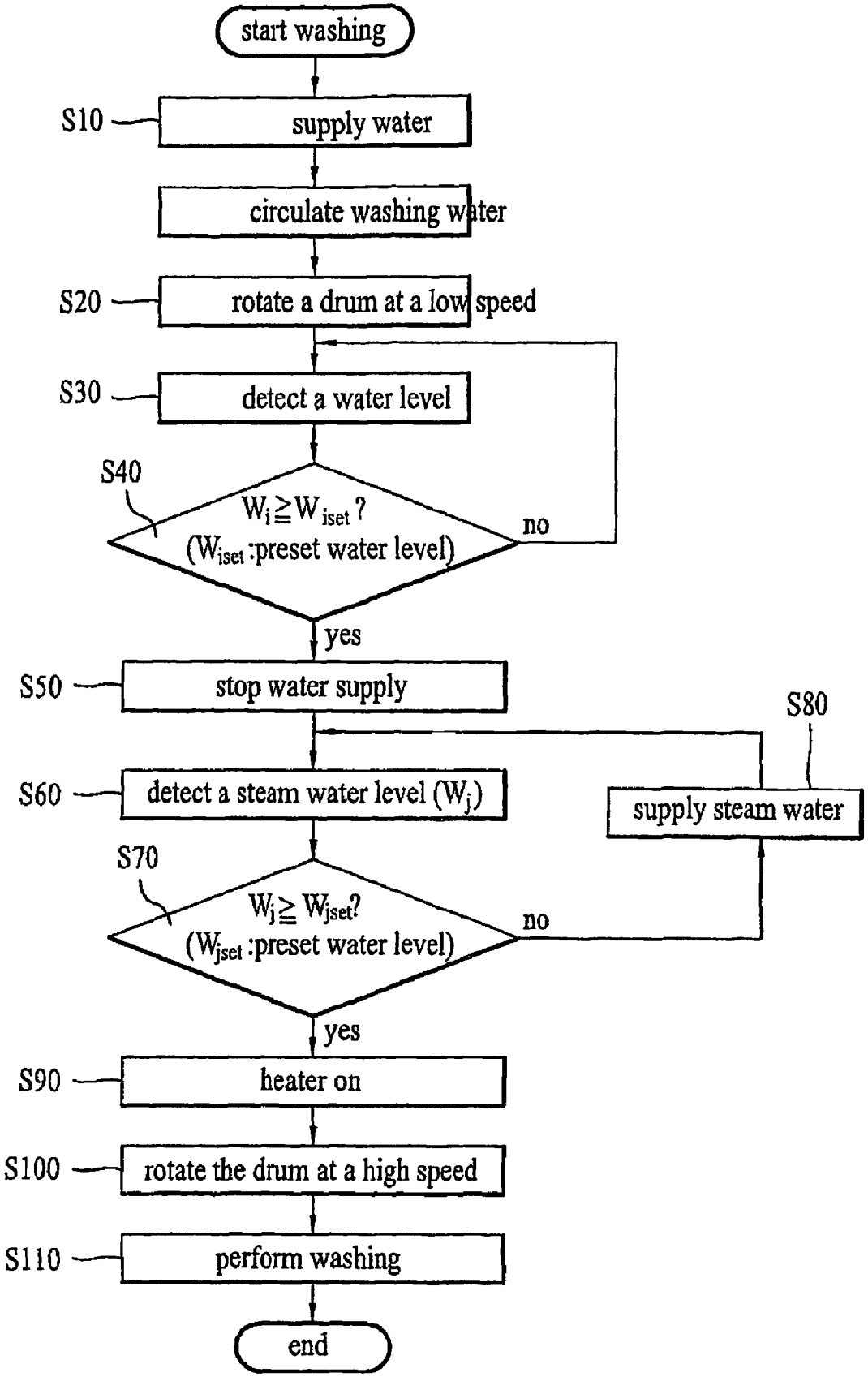

STEAM WASHING METHOD FOR WASHING MACHINE AND WASHING MACHINE WITH THE SAME

This application claims the benefit of Korean Patent Application No. 2005-0026045, filed on Mar. 29, 2005 and PCT Application No. PCT/KR2006/000458, filed on Feb. 8, 2006, which is hereby incorporated by reference for all purposes as if fully set forth herein.

TECHNICAL FIELD

The present invention relates to a method of a washing machine for washing laundry with steam; and a washing machine thereof, and more particularly, to a method of a washing machine for washing laundry with steam, for improving sterilizing and washing performance and reducing water and energy consumption.

BACKGROUND ART

FIG. 1 illustrates a section of a related art washing machine. As shown, the washing machine is provided with a cabinet 11 of an exterior of the washing machine, a tub 21 in the cabinet 11 for holding washing water, and a drum 31 rotatably mounted in the tub 21. There are suspension springs 23 and dampers 25 over and under the tub 21 for suspending the tub 21.

Above the tub 21, there is a detergent supply unit 27 for supplying detergent, and on one side of the tub 21, there is a water supply pipe 35 having a water supply valve 37 mounted thereon. Secured to a rear of the tub 21, there is a drum driving motor 29 for rotating the drum 31. Under the tub 21, there are a drain line 32 and a drain pump 34 for draining, and on a bottom of the tub 21, there are a heater room 24 and a heater 26 for heating washing water held therein.

In the meantime, there are a plurality of lifters 33 on an inside of the drum 31 each projected in a radial direction and extended in an axis direction for lifting and dropping the laundry.

According to above configuration, once the laundry is introduced into the drum 31 and a washing cycle is started, the water supply valve 37 is opened, and the detergent and the washing water is supplied to the tub 21. In this instance, as the drum 31 rotates in regular/reverse directions, the laundry wet with water, to drop a water level of the washing water in the tub 21. For making up the drop of the water level, washing water is supplied, additionally.

If the drum 31 rotates, a washing action is made as the laundry in the drum 31 is lifted up and dropped down. The heater 26 heats the washing water to a preset temperature according to user's selection, to improve a washing performance.

Once the washing is finished, the drain pump 34 is driven, to make drain, and the drum 31 is rotated, to make so called intermittent spinning for smooth draining of the washing water from the laundry.

Upon finishing the draining, while rotating the drum 31, water is supplied to the tub 21, to perform rinsing. After repeating the rinsing and the intermittent spinning a few times, spinning is performed finally, to finish the washing.

However, the related art method for washing laundry by a washing machine has problems in that the heater room 24 recessed down in a bottom of the tub 21 and heater 26 arranged therein for heating the washing water held in the heater room 24 makes the washing and rinsing poor due to detergent remained in the heater room 24, and increases consumption of the washing water and power due to an amount of washing water required to fill the heater room 24, additionally.

DISCLOSURE OF INVENTION

Technical Problem

An object of the present invention, designed to solve the problems in the related art, lies on providing a method of washing machine for washing laundry with steam, which can improve sterilizing and washing performances and reduce water and energy consumption.

Technical Solution

The object of the present invention can be achieved by providing a method of a washing machine for washing laundry with steam, the washing machine having a tub for holding washing water, and a steam generator for generating and supplying steam to the tub, including a steam supply step for supplying the steam to the tub for washing the laundry.

In a case of a drum type washing machine having a drum rotatably mounted in the tub, it is preferable that the drum is rotated in the steam supply step, so that the steam can be brought into contact with the laundry, quickly and uniformly.

The high temperature sterilization by steam enables to wash the laundry clean hygienically.

The supply of steam can be made during or before a main washing step in which the laundry is washed in full swing. If the supply of steam is made before the main washing step, the steam assists soaking the laundry. In this case, after the washing water is supplied to the tub to wet the laundry, the steam may be supplied.

If the steam is supplied during the main washing in which the laundry is washed in full swing with detergent, action of the detergent becomes active, and a temperature of the laundry becomes higher, to make a good washing.

Moreover, depending on kinds of fabrics, properties of the fabric changes substantially according to a temperature of the fabric in a wet state. Therefore, the supply of steam softens the fabric, to improve the washing effect and prevent the fabric from wrinkling.

In order to enhance the sterilizing effect and softening of the fabric to remove or preventing the wrinkles, the steam supply step may be made after the main washing is made fully. Particularly, the wrinkles of fabric formed as the fabric is subjected to spinning can be removed by supplying the steam, which softens the fabric.

In a case hot water is used instead of the steam, not only a temperature as high as the steam is not available, but also power consumption increases as it is required to heat a great amount of water.

The use of the steam solves above drawbacks, and if the steam is used together with hot water, the washing effect can be increased further.

The method further includes a washing water circulating step for circulating the washing water from the tub to the tub again.

The circulation of the washing water enables washing with use of a small amount of water. If there is no washing water circulating step, the washing water will be required the much.

Moreover, the circulation of the washing water enables quick and uniform wetting of the laundry and to assist the detergent brought into contact with the laundry uniformly at an early stage of washing. Therefore, it is preferable that the washing water is also circulated when the washing water is supplied to the tub.

The circulation of the washing water in the main washing step forms a water current that induces a washing effect. Particularly, if the circulating washing water is supplied dropping from an upper side of the tub, to hit the laundry, the washing effect is enhanced as the dropping washing water induces the washing effect.

The circulation of the washing water assists dissolution of the powder detergent, to prevent the detergent not dissolved yet from depositing on a bottom of the tub and wasted without being used.

Other than this, the circulation of the washing water has a variety of good effects. For an example, the circulation of the washing water eliminates the possible difference of washing water temperature. The difference is the same with contaminants drained from the laundry by washing.

In other aspect of the present invention, a method of a washing machine for washing laundry with steam, the washing machine having a tub for holding washing water, a drum rotatably mounted in the tub, and a steam generator for generating and supplying steam to the tub, includes a washing water supply step for supplying washing water to the tub, a steam supply step for supplying the steam to the tub, and a main washing step for washing the laundry.

The method may further include a washing water circulating step for circulating the washing water from the tub to the drum and vice versa while at least one of the steps is in progress.

Preferably, the rotation speed of the drum in the main washing step is higher than the rotation speed of the drum in the steam supply step.

It is preferable that the rotation speed of the drum in the main washing step is enough to bring the laundry in the drum into close contact with an inside surface of the drum by centrifugal force. The laundry brought into close contact with the inside surface of the drum by the centrifugal force is lifted and fallen. If there are lifters in the drum, the lifters lifts the laundry upward and drops the laundry. In this case, the rotation speed of the drum may be slower. The drop of the laundry induces another washing effect.

The close contact of the laundry with the inside surface of the drum enough to rotate together with drum makes the laundry spread in the inside surface of the drum widely, enabling the laundry to be in smoother contact with the steam. In a state the laundry is accumulated on a bottom of the drum, with much portion of the laundry not exposed to air, the contact of the laundry with the steam becomes the smaller.

In the meantime, as described before, the washing machine of the present invention is a washing machine that can washing laundry with steam.

The washing machine includes a tub for holding washing water, a steam generator for supplying steam to the tub, and a controller for controlling the steam generator to supply the steam to the tub for washing laundry.

The washing machine may further include a circulating pump for drawing the washing water from the tub and return to the tub again under the control of the controller.

The washing machine of the present invention performs washing as the controller controls the washing machine when the user selects a washing course, particularly, the steam generator to supply steam to the tub, for performing the washing.

Preferably, the controller includes a microcomputer, having a program for performing above the foregoing washing.

Advantageous Effects

Because the present invention washes laundry with steam, the present invention has the following advantages.

For an example, the steam has a sterilizing effect, and improves an washing effect. A good washing effect can be provided even if a small amount of washing water is used, and power required for heating the washing water can be reduced. Moreover, since the steam diffuses, the steam can be in contact with the laundry, uniformly.

In the meantime, as described before, the circulation of the washing water can provide various effects.

For an example, consumption of the washing water can be reduced, enabling to prevent the water from wasting, and improves the washing effect.

Moreover, if the steam is supplied to the laundry in a state the laundry is submerged in the washing water to a certain extent, the steam may not reach to a portion of the laundry submerged in the washing water. In this instance, if the washing water is circulated, since the washing water is removed from the tub as much as the washing water is circulated, to expose the portion submerged in the washing water to air, the portion can be in contact with the steam. Accordingly, if an appropriate amount of washing water is used, the washing water circulation assists to improve the washing effect of the steam.

BRIEF DESCRIPTION OF THE DRAWINGS

FIG. 1 illustrates a section of a related art washing machine;

FIG. 2 illustrates a diagram for explaining a method of a washing machine for washing laundry with steam in accordance with a preferred embodiment of the present invention;

FIG. 3 illustrates a block diagram for controlling the washing machine in FIG. 2; and FIG. 4 illustrates a flow chart showing a method of a washing machine for washing laundry with steam in accordance with a preferred embodiment of the present invention.

BEST MODE FOR CARRYING OUT THE INVENTION

The present invention will be described in detail with reference to the attached drawings.

FIG. 2 illustrates a diagram for explaining a method of a washing machine for washing laundry with steam in accordance with a preferred embodiment of the present invention, FIG. 3 illustrates a block diagram for controlling the washing machine in FIG. 2, and FIG. 4 illustrates a flow chart showing a method of a washing machine for washing laundry with steam in accordance with a preferred embodiment of the present invention. Wherever possible, the same reference numbers will be used throughout the drawings to refer to the same or like parts. As shown in FIG. 2, the washing machine includes a cabinet 11 of an exterior of the washing machine, a tub 21 arranged in a front/rear direction in the cabinet 11 for holding washing water, a drum 31 rotatably mounted in the tub 21, a detergent supply unit 27 for supplying detergent to the tub 21, a steam generator 51 in the cabinet 11 above the tub 21, for generating steam, and a spraying unit 58 for spraying steam from the steam generator 51 into the tub 21.

Under the tub 21, there is a circulating pump 43 for circulating the washing water in the tub 21, with an outlet connected to the spraying unit 58 above the tub 21.

The steam generator 51 includes a case 52 having a space therein, a heater (not shown) mounted to the case 52 for heating water in the case 52, a steam water level sensor 55 for sensing a water level of the case 52. Connected to one side of the case 52, there is a water supply pipe 54 for supplying water, with a water supply valve 56 mounted thereon for opening/closing the water supply pipe 54. At the other side of the case 52, there is a steam outlet flow passage 57 for discharging steam generated by heating of the heater, with the spraying unit 58 connected to a downstream side of the steam outlet flow passage 57 for spraying the steam into the tub 21.

In the meantime, referring to FIG. 3, there is a control unit 61 in a form of a microcomputer having a control program programmed therein, electrically connected to a cumulative operation time period calculating unit 63 for calculating a cumulative operation time period after starting a washing course selective from a plurality of washing courses, the water supply valve 37 for supplying washing water, a water level sensor 67 for sensing a water level of the tub 21, a temperature sensor 65 mounted to the drum 31 or the tub 21 for calculating a temperature or the washing water or the laundry, a drum driving motor 29 for rotating the drum 31, the circulating pump 43 for circulating the washing water in the tub 21, the water supply valve 56 for opening/closing the water supply pipe 54 of the steam generator 51, the steam water level sensor 55 for sensing a water level of steam water to be turned into steam, and the heater 59. The control unit 61 has a plurality of washing courses to be programmed therein for washing the laundry at various set temperatures (for an example, 30° C., 50° C., 70° C., and 90° C.) of the washing water or the laundry in the tub 21 for improving a washing performance.

A method for washing laundry with steam of a washing machine having the foregoing system will be described with reference to FIG. 4.

If one washing course is selected from the plurality of washing courses each having a heating temperature different from one another, the control unit 61 controls the water supply valve 37 for supplying washing water to the tub 21 (S10).

While the washing water is supplied, the control unit 61 controls to drive the drum driving motor 29, for rotating the drum 31 (S20).

The drum 31 is rotated for sensing an amount of the laundry, as well as making smooth wetting of the laundry in the drum 31, preferably at a rotation speed relatively lower than a rotation speed at the time of a general washing or spinning.

Moreover, the control unit 61 detects the water level Wi periodically with the water level sensor 67 after starting the water supply (S30), and controls the water supply valve 37 to stop the water supply (S50) if the water level Wi detected thus reaches to a preset water level Wiset (S40).

In the meantime, while above series of the water supply steps are in progress, the circulating pump 41 may be driven to circulate the washing water from the tub 21 to the drum 31.

This is a series of steps for making smoother wetting of the laundry, and particularly, taking the fact that the washing water circulating thus at the time of the water supply contains detergent into account, enables the detergent to permeate throughout entire portion of the laundry, uniformly.

Then, the control unit 61 controls the steam water level sensor 55 of the steam generator 51 to detect the steam water level Wj (S60), and controls the steam water supply valve 56 to supply the steam water (S80) if the water level Wj detected thus is lower than the preset water level Wjset (S70).

In this instance, the steam water may be supplied at the same time with the washing water supply.

If the steam water level Wj reaches to the preset water level Wjset during above series of steps are in progress (S70), the control unit 61 applies power to the heater 59 for vaporizing the steam water supplied thus (S90).

Eventually, the steam is generated by the steam generator, and the steam generated thus is sprayed into the drum 31.

In this instance, the drum driving motor 29 is controlled to rotate the drum 31, preferably at a rotation speed faster than the rotation speed of the drum 31 at the time of the washing water supply, for an example, higher than 400RPM, so that the laundry in the drum 31 is in close contact with an inside surface of the drum 31 as one unit with the drum 31 to form a hollow at a center of the drum 31 (S100).

This is a series of steps for improving a washing performance of the laundry in the drum 31. That is, pieces of the laundry are made to be brought into close contact with the inside surface of the drum 31, not in an entangled state, but in a separated state, so that the steam is provided throughout the laundry uniformly, for improving the washing performance.

Especially, as the drum rotates at a high speed at the time of the steam spray in a state the laundry is in close contact with the inside surface of the drum by centrifugal force to form a hollow at a center of the drum, the steam sprayed thus flows through the hollow smoothly, and contact to the laundry uniformly, thereby reducing a heating time period, to reduce water and power consumption, significantly.

In the meantime, while the steam spraying step is in progress, the circulating pump 41 may be driven like in the water supply step, for circulating the washing water from the tub 21 to the drum 31 and vice versa.

Then, upon finishing above series of steps, an actual washing of the laundry in the drum 31 is preformed (S110).

In this instance, the washing is progressed by rotating the drum 31 in regular/reverse directions periodically and repeatedly like a general washing step.

Moreover, while the washing step is in progress too, a series of steps may be performed in which the circulating pump 41 is driven, for circulating the washing water from the tub 21 to the drum 31 and vice versa.

INDUSTRIAL APPLICABILITY

The present invention relates to a method of a washing machine for washing laundry with steam, and a washing machine thereof, and more particularly, to a method of a washing machine for washing laundry with steam, for improving sterilizing and washing performance and reducing water and energy consumption.

Because the present invention washes laundry with steam, the present invention has the following advantages.

For an example, the steam has a sterilizing effect, and improves an washing effect. A good washing effect can be provided even if a small amount of washing water is used, and power required for heating the washing water can be reduced. Moreover, since the steam diffuses, the steam can be in contact with the laundry, uniformly.

In the meantime, as described before, the circulation of the washing water can provide various effects.

For an example, consumption of the washing water can be reduced, enabling to prevent the water from wasting, and improves the washing effect.

Moreover, if the steam is supplied to the laundry in a state the laundry is submerged in the washing water to a certain extent, the steam may not reach to a portion of the laundry submerged in the washing water. In this instance, if the washing water is circulated, since the washing water is removed from the tub as much as the washing water is circulated to expose the portion submerged in the washing water to air, the portion can be in contact with the steam. Accordingly, if an appropriate amount of washing water is used, the washing water circulation assists to improve the washing effect of the steam.

The invention claimed is:

1. A method of a washing machine for washing laundry with steam, the washing machine having a tub for holding washing water, a drum rotatably mounted in the tub, and a steam generator for generating and supplying steam to the tub, comprising;

a washing water supply step for supplying washing water to the tub;

a steam supply step for supplying the steam to the tub; and a main washing step for washing the laundry, wherein the steam supply step includes the step of rotating the drum at a rotation speed lower than a rotation speed of the drum in the main washing step.

2. The method as claimed in claim 1, further comprising a washing water circulating step for circulating the washing water by extracting water from the tub and supplying the water to the tub so as to be introduced into the drum while at least one of the steps is in progress.

3. The method as claimed in claim 2, wherein the steam supply step is performed during the main washing step is in progress.

4. The method as claimed in claim 2, wherein the steam supply step includes the step of rotating the drum at a rotation speed lower than a rotation speed of the drum in the main washing step.

5. The method as claimed in claim 4, wherein the main washing step includes the step of rotating the drum at a rotation speed higher than a rotation speed at which the laundry is in close contact with an inside surface of the drum to form a hollow at a center of the drum such that the laundry rotates with the drum as one unit.

6. The method as claimed in claim 1, wherein the steam supply step is performed during the main washing step is in progress.

7. The method as claimed in claim 1, wherein the main washing step includes the step of rotating the drum at a rotation speed at which the laundry is in close contact with an inside surface of the drum such that the laundry rotates with the drum as one unit.

* * * * *